US011896111B2

(12) United States Patent
Hang et al.

(10) Patent No.: US 11,896,111 B2
(45) Date of Patent: Feb. 13, 2024

(54) GUM-FREE ENVIRONMENTAL-FRIENDLY LIPSTICK TUBE

(71) Applicants: Jianping Hang, Yuyao (CN); Neng Zhu, Yuyao (CN)

(72) Inventors: Jianping Hang, Yuyao (CN); Neng Zhu, Yuyao (CN)

( * ) Notice: Subject to any disclaimer, the term of this patent is extended or adjusted under 35 U.S.C. 154(b) by 0 days.

(21) Appl. No.: 17/617,320

(22) PCT Filed: Apr. 14, 2020

(86) PCT No.: PCT/CN2020/084646

§ 371 (c)(1),
(2) Date: Dec. 8, 2021

(87) PCT Pub. No.: WO2021/128657

PCT Pub. Date: Jul. 1, 2021

(65) Prior Publication Data

US 2022/0312936 A1 Oct. 6, 2022

(30) Foreign Application Priority Data

Dec. 26, 2019 (CN) ..... 201922381443.0

(51) Int. Cl.
*A45D 40/06* (2006.01)
*A45D 40/04* (2006.01)

(52) U.S. Cl.
CPC ..... *A45D 40/06* (2013.01); *A45D 40/04* (2013.01)

(58) Field of Classification Search
CPC ..... A45D 40/04; A45D 40/06
USPC ..... 401/75
See application file for complete search history.

(56) References Cited

FOREIGN PATENT DOCUMENTS

| | | | |
|---|---|---|---|
| CN | 203860652 U | | 10/2014 |
| CN | 206182600 U | | 5/2017 |
| CN | 206791972 U | | 12/2017 |
| CN | 210930078 U | * | 7/2020 |

* cited by examiner

*Primary Examiner* — Jennifer C Chiang
(74) *Attorney, Agent, or Firm* — Jose Cherson Weissbrot

(57) ABSTRACT

A gum-free environmental-friendly lipstick tube comprises a lifting tube, a spiral tube, a median bundle core and a base mounted successively in a sleeving manner from inside to outside. An inner wall of the base has a first flange and a plurality of strip-type grooves. The spiral tube has a first annular groove corresponding to the first flange and a strip-type clamping block corresponding to the strip-type groove. Additionally, the spiral tube has a second flange, while an inner wall of the median bundle core has a second annular groove corresponding to the second flange. An inner wall of the spiral tube has an internal thread, and the lifting tube has an external thread corresponding to the internal thread.

4 Claims, 7 Drawing Sheets

GUM-FREE ENVIRONMENTAL-FRIENDLY LIPSTICK TUBE

TECHNICAL FIELD

The present invention relates to the technical field of lipstick tubes, in particular to a gum-free environmental-friendly lipstick tube.

BACKGROUND

Ecological civilization construction expands a new field for industrial design, so that industrial design shall fit the requirements on ecological civilization construction and reflect ideas such as greenness, environmental protection and low carbon. For us, solution of problems of packaging waste and environmental pollution has both social benefit and economical benefit. Polyethylene terephthalate (PET), as one of five engineering plastics, is non-toxic, tasteless and good in sanitary safety first, can be directly used for food packaging, and is just suitable for being used as a packaging material for packaging make-up products, in particular packaging of a lipstick tube. Then, it has good mechanical properties, its impact strength is 3-5 times of that of other films, it is good in fold resistance, oil resistant, fatty resistant, dilute acid resistant and dilute alkali resistant, and it is not easily conflicted with a filling paste chemically. Further, in the engineering plastic, its price is favorable, has very high cost performance and is low in cost. However, a common median bundle core structure is spiral internally and is formed by rotary core-pulling and demolding, a core cannot be connected to cooling water, and the spiral tube is stretched and deformed in a demolding process and even it is unable to demold due to a property of a PET material which is easy to be stuck to a mold, so that the common median bundle core structure is not made from a full PET material. The PET material is replaced by other materials, which enables the median bundle core and the lipsticks tube to lead to pollution easily, so that it is poor in environmental friendliness. Specifically, an existing lipstick tube structure in the market is formed by assembling a plurality of components. The materials of the components cannot be single PET materials uniformly, so that recovery treatment and environmental protection are not facilitated as it is necessary to dismantle the components respectively when the whole lipstick tube is scrapped.

SUMMARY

In order to solve the technical problem, the present invention aims to provide a gum-free environmental-friendly lipstick tube. The gum-free environmental-friendly lipstick tube can solve the problem of environmental pollution as the median bundle core in the lipstick tube in the prior art cannot be machined by using the uniform PET material.

A technical scheme adopted by the present invention to solve the technical problem is that a gum-free environmental-friendly lipstick tube includes a lifting tube, a spiral tube, a median bundle core and a base mounted successively in a sleeving manner from inside to outside. An inner wall of the base is provided with a first flange and a plurality of strip-type grooves, and the spiral tube is provided with a first annular groove corresponding to the first flange and a strip-type clamping block corresponding to the strip-type groove. The spiral tube is further provided with a second flange, an inner wall of the median bundle core is provided with a second annular groove corresponding to the second flange, the spiral tube can rotate relative to the median bundle core, and the spiral tube is provided with an elastic sheet which can compensate changes of twisting forces due to the median bundle cores of different dimensions, so that the lipstick tube is more stable and smooth in hand feeling when being used; an inner wall of the spiral tube is provided with an internal thread, and the lifting tube is provided with an external thread corresponding to the internal thread. During use, the base is rotated, and the base drives the spiral tube to rotate, and when the spiral tube rotates, it drives the lifting tube ascends.

Further, the base is provided with an upper cover in a sleeved manner, a top end of the base is provided with a spherical protrusion, and an inner wall of the upper cover is provided with a third annular groove.

Further, the lifting tube is provided with a first special-shaped surface, and an inner wall of the median bundle core is provided with a second special-shaped surface corresponding to the first special-shaped surface for preventing the lifting tube from rotating horizontally in an upward and downward moving process.

Compared with the prior art, the present invention has the advantages that according to the gum-free environmental-friendly lipstick tube provided by the present invention, a thread of a conventional median bundle tube is adjusted to the internal spiral tube and lifting tube, so that in a machining process of the median bundle tube, and the median bundle tube can be machined by using the PET material, the spiral tube is matched with the base, and it is unnecessary to gum and reinforce; the elastic sheet on the spiral tube can compensate changes of twisting forces caused by the median bundle tubes with different dimensions, so that the lipstick tube is more stable and smooth in hand feeling when being used; compared with a common lipstick tube, the lipstick tube is more environmental-friendly and can be recycled. That is, the components in the whole lipstick tube can be machined by using the uniform PET material, and the whole lipstick tube is scrapped when it is scrapped without dismantling the components separately, so that uniform recovery is facilitated, and a condition of environmental pollution after the components are scraped is avoided.

Figure 1:
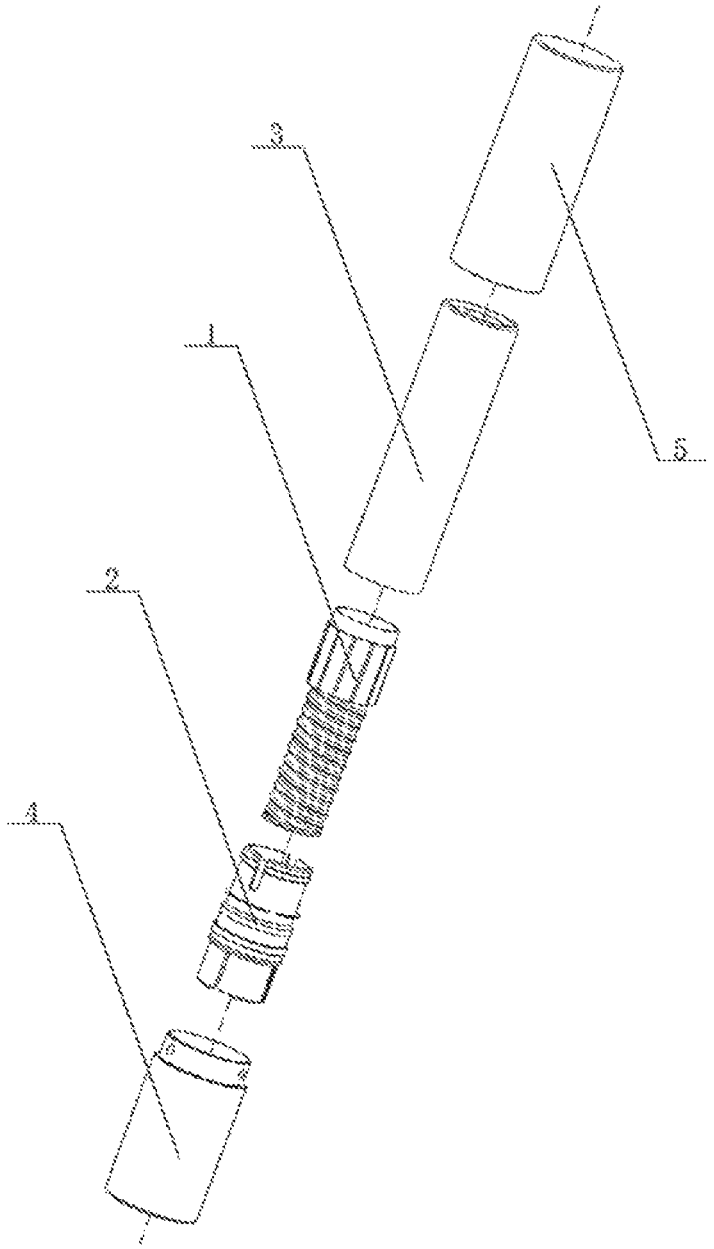
FIG. 1 is an exploded view of a gum-free environmental-friendly lipstick tube in an embodiment of the present invention.

1, lifting tube; 101, external thread; 102, first special-shaped surface; 2, spiral tube; 201, first annular groove; 202, strip-type clamping block; 203, second flange; 204, internal thread; 205, elastic sheet; 3, median bundle core; 301, second annular groove; 302, second special-shaped surface; 4, base; 401, first flange; 402, strip-type groove; 403, spherical protrusion; 5, upper cover; 501, third annular groove.

DETAILED DESCRIPTION OF THE EMBODIMENTS

Further description of the present invention in detail will be made below in combination with drawings and embodiments.

Referring to FIG. 1 to FIG. 7, the embodiment of the present invention provides a gum-free environmental-friendly lipstick tube, including a lifting tube 1, a spiral tube 2, a median bundle core 3 and a base 4 mounted successively in a sleeving manner from inside to outside.

Referring to FIG. 2 to FIG. 5, an inner wall of the base 4 is provided with a first flange 401 and a plurality of strip-type grooves 402, the spiral tube 2 is provided with a first annular groove 201 corresponding to the first flange 401 and a strip-type clamping block 202 corresponding to the strip-type groove 402, the spiral tube 2 and the base 4 are fixed via the first annular groove 201 and the strip-type clamping block 202, and it is unnecessary to fix via a gum body, thereby playing an environmental protection role; the spiral tube 2 is further provided with a second flange 203, an inner wall of the median bundle core 3 is provided with a second annular groove 301 corresponding to the second flange 203, the spiral tube 2 can rotate relative to the median bundle core 3, an inner wall of the spiral tube 2 is provided with an internal thread 204, and the lifting tube 1 is provided with an external thread 101 corresponding to the internal thread 204; therefore, when the spiral tube 2 rotates, it is to drive the lifting tube 1 to ascend by means of the matched internal and external threads; and during use, the base 4 is rotated, and the base 4 drives the spiral tube 2 to rotate, so that the lifting tube 1 ascends.

Figure 6:
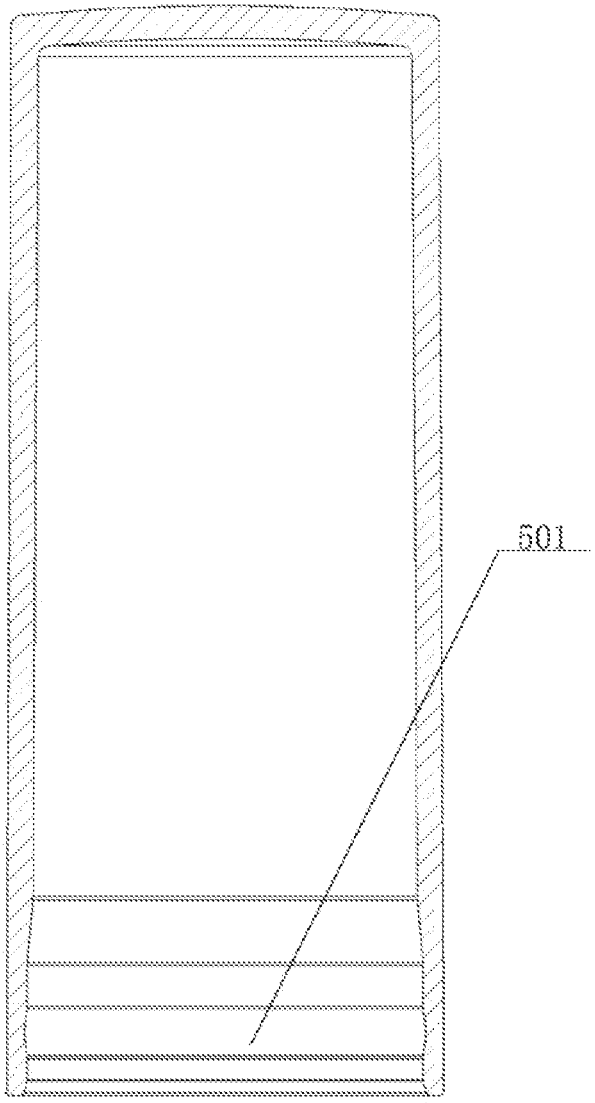
FIG. 6 is a section view of an upper cover of a gum-free environmental-friendly lipstick tube in an embodiment.
Figure 7:
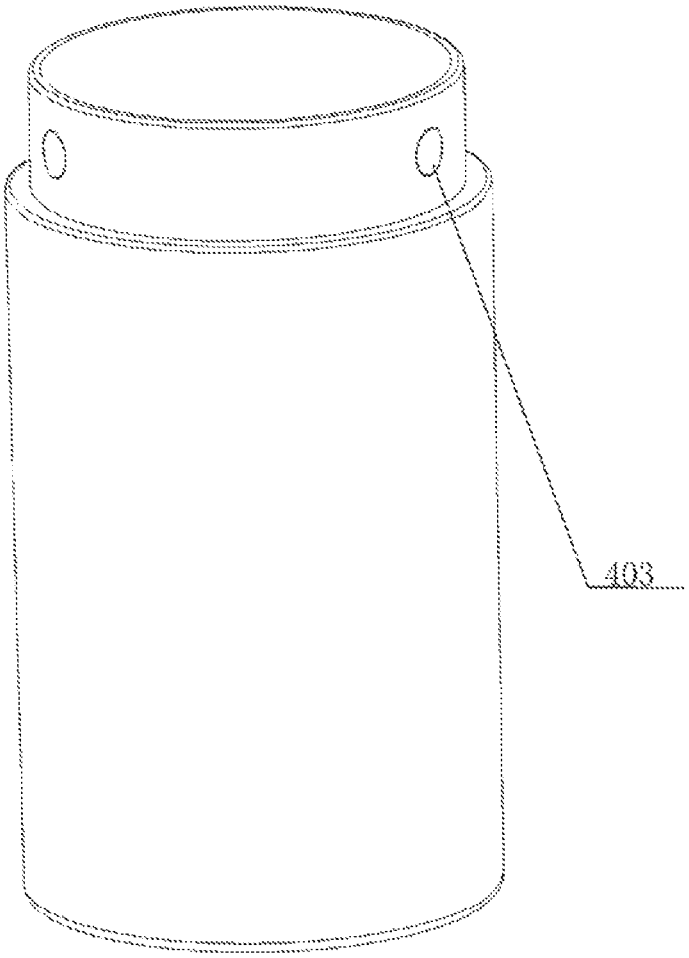
FIG. 7 is a stereogram of a base of a gum-free environmental-friendly lipstick tube in an embodiment.

Referring to FIG. 6 to FIG. 7, the base 4 is provided with an upper cover 5 in a sleeving manner, herein the top end of the base 4 is provided with a spherical protrusion 403, an inner wall of the upper cover 5 is provided with a third annular groove 501, and the spherical protrusion 403 can be clamped into the third annular groove 501 to play a positioning role.

Figure 4:
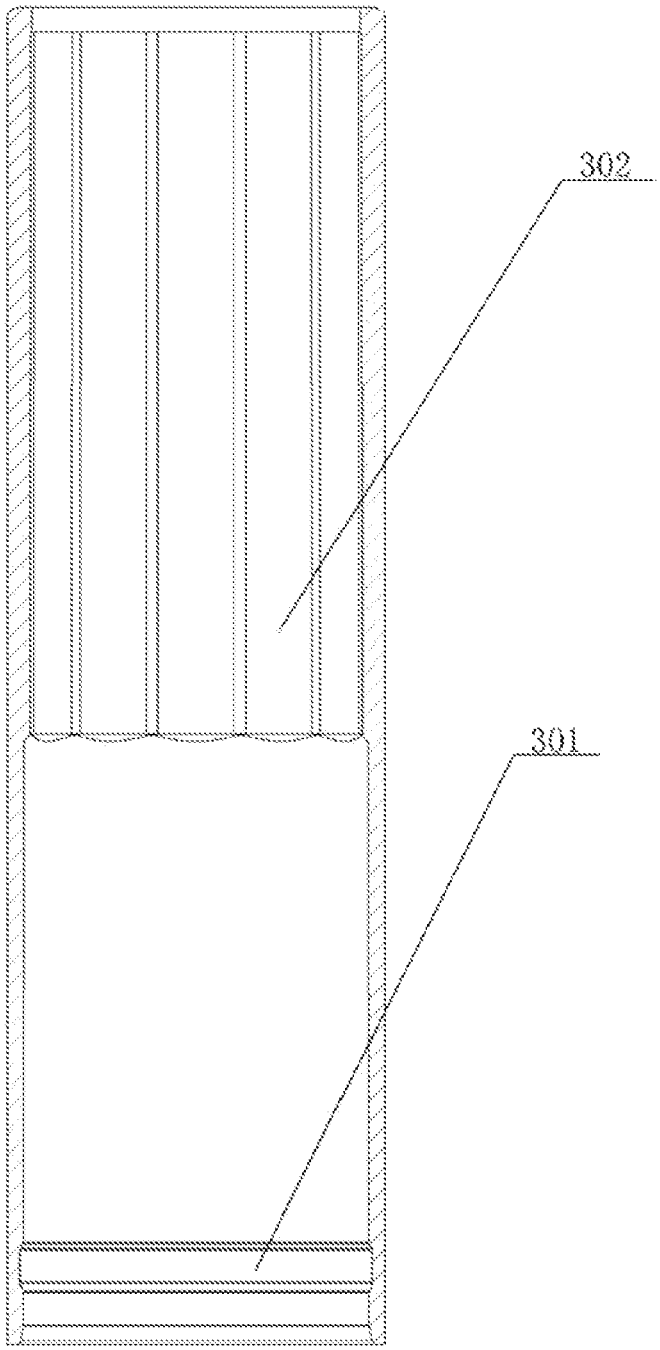
FIG. 4 is a section view of a median bundle tube of a gum-free environmental-friendly lipstick tube in an embodiment of the present invention.
Figure 5:
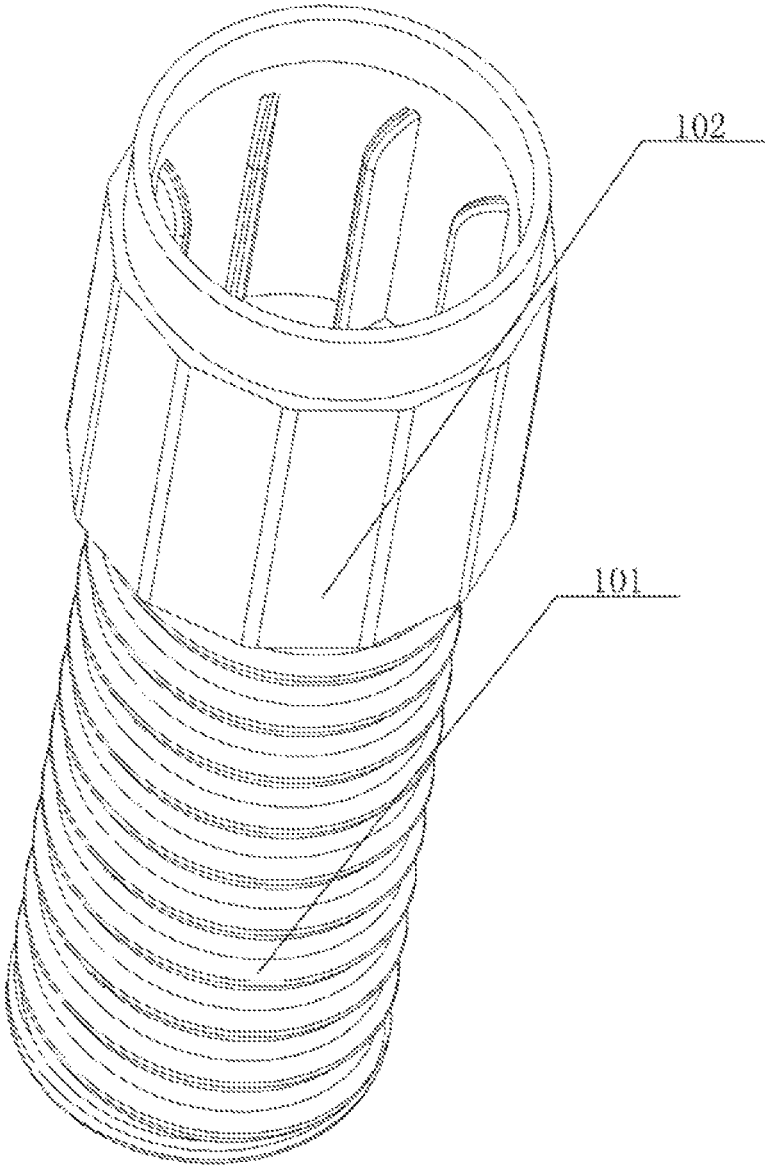
FIG. 5 is a stereogram of a lifting tube of a gum-free environmental-friendly lipstick tube in an embodiment of the present invention.

Referring to FIG. 4 to FIG. 5, the lifting tube 1 is provided with a first special-shaped surface 102, and an inner wall of the median bundle core 3 is provided with a second special-shaped surface 302 corresponding to the first special-shaped surface 102. The lifting tube 1 is prevented from rotating horizontally in a lifting process along the median bundle core 3 by matching the two special-shaped surfaces.

Figure 2:
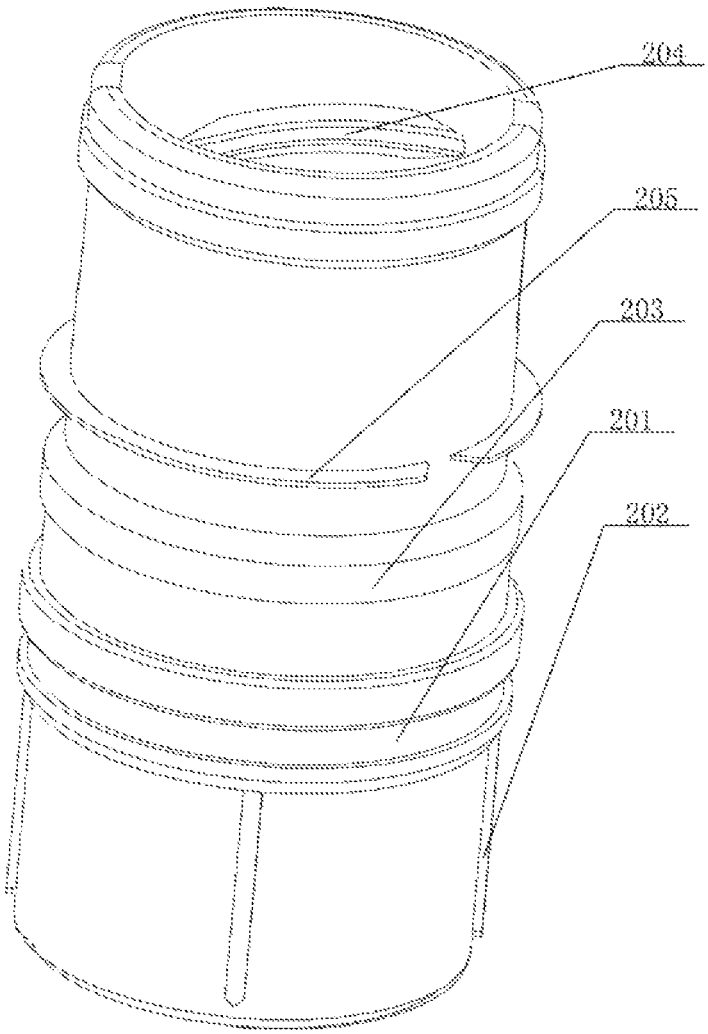
FIG. 2 is a stereogram of a spiral tube of a gum-free environmental-friendly lipstick tube in an embodiment of the present invention.
Figure 3:
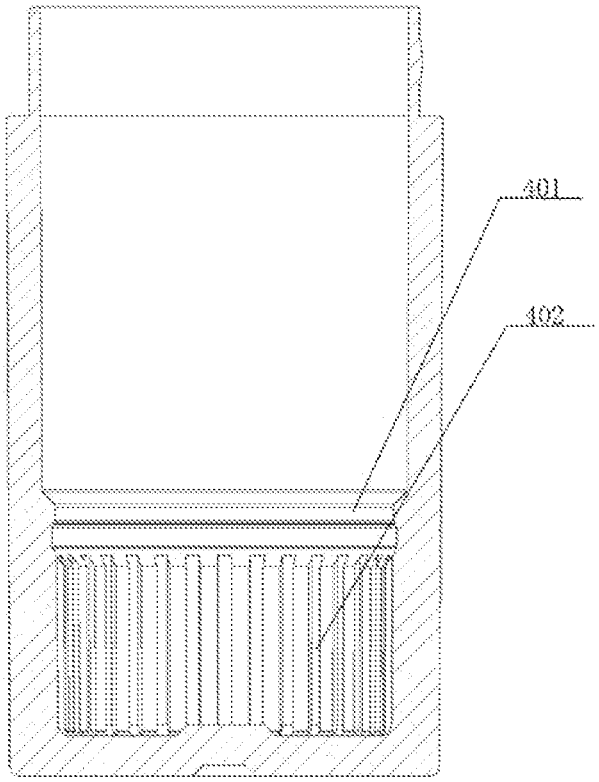
FIG. 3 is a section view of a base of a gum-free environmental-friendly lipstick tube in an embodiment.

Referring to FIG. 2, the spiral tube 2 is further provided an elastic sheet 205. The elastic sheet 205 can compensate changes of twisting forces due to the median bundle cores of different dimensions, so that the lipstick tube is more stable and smooth in hand feeling when being used.

According to the gum-free environmental-friendly lipstick tube in the embodiment of the present invention, a thread of a conventional median bundle tube is adjusted to the internal spiral tube and lifting tube, so that in a machining process of the median bundle tube, and the median bundle tube can be machined by using the PET material, and the lipstick tube is higher in strength and convenient to recover, thereby playing an environmental-friendly role; and the spiral tube is matched with the base, and it is unnecessary to gum and reinforce, so that environmental protection is further facilitated; the elastic sheet on the spiral tube can compensate changes of twisting forces caused by the median bundle tubes with different dimensions, so that the lipstick tube is more stable and smooth in hand feeling when being used.

The above examples are the preferred embodiments of the present invention. It should be noted that improvements and embellishments shall be made within the protection range of the disclosure to those skilled in the technical field without departing the principle of the present invention.

What is claimed is:

1. A gum-free environmental-friendly lipstick tube, comprising a lifting tube, a spiral tube, a median bundle core and a base mounted successively in a sleeving manner from inside to outside, wherein an inner wall of the base is provided with a first flange and a plurality of strip-type grooves, and the spiral tube is provided with a first annular groove corresponding to the first flange and a strip-type clamping block corresponding to the strip-type groove; the spiral tube is further provided with a second flange, and an inner wall of the median bundle core is provided with a second annular groove corresponding to the second flange; an inner wall of the spiral tube is provided with an internal thread, and the lifting tube is provided with an external thread corresponding to the internal thread; and during use, the base is rotated, and the base drives the spiral tube to rotate, so that the lifting tube ascends.

2. The gum-free environmental-friendly lipstick tube of claim 1, wherein the base is provided with an upper cover in a sleeved manner, a top end of the base is provided with a spherical protrusion, and an inner wall of the upper cover is provided with a third annular groove.

3. The gum-free environmental-friendly lipstick tube of claim 1, wherein the lifting tube is provided with a first special-shaped surface, and an inner wall of the median bundle core is provided with a second special-shaped surface corresponding to the first special-shaped surface.

4. The gum-free environmental-friendly lipstick tube of claim 1, wherein the spiral tube is provided with an elastic sheet.

* * * * *